US008038249B2

(12) United States Patent
Hayashi et al.

(10) Patent No.: US 8,038,249 B2
(45) Date of Patent: Oct. 18, 2011

(54) INK JET RECORDING APPARATUS, AND METHOD FOR CONTROLLING RECORDING HEAD TEMPERATURE

(75) Inventors: Satoshi Hayashi, Yokohama (JP); Yasunori Fujimoto, Inagi (JP); Jun Shimoji, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 115 days.

(21) Appl. No.: 11/693,457

(22) Filed: Mar. 29, 2007

(65) Prior Publication Data

US 2007/0229567 A1 Oct. 4, 2007

(30) Foreign Application Priority Data

Mar. 31, 2006 (JP) ..... 2006-098006
Mar. 6, 2007 (JP) ..... 2007-055761

(51) Int. Cl.
*B41J 29/38* (2006.01)

(52) U.S. Cl. ..... 347/17; 347/5; 347/9

(58) Field of Classification Search ..... 347/17, 347/5, 9, 19
See application file for complete search history.

(56) References Cited

U.S. PATENT DOCUMENTS 6,286,926 B1 * 9/2001 Hirabayashi et al. ..... 347/17
2005/0088473 A1 * 4/2005 Holstun et al. ..... 347/17

FOREIGN PATENT DOCUMENTS

JP 2731274 B2 12/1997

* cited by examiner

*Primary Examiner* — Lam S Nguyen
(74) *Attorney, Agent, or Firm* — Fitzpatrick, Cella, Harper & Scinto

(57) ABSTRACT

An ink jet recording apparatus for effecting recording using a recording head for ejecting ink, the ink jet recording apparatus including a heating section for heating the recording head, a detecting unit for detecting a temperature of the recording head, a setting unit for setting a target temperature of the recording head, and a controller for controlling the target temperature of the recording head at or above the target temperature. The controller controls the temperature by heating control for heating the recording head and by diffusing control for diffusing the heat supplied by the heating control.

13 Claims, 10 Drawing Sheets

(a) TARGET TEMP. SETTING TABLE

| RANGES | TEMP | HMDTY | TARGET |
|---|---|---|---|
| A | ~18°C | ~35% | 50°C |
| B | 19~28°C | ~35% | 50°C |
| C | 29°C~ | ~35% | 50°C |
| D | ~18°C | 36~65% | 50°C |
| E | 19~28°C | 36~65% | 45°C |
| F | 29°C~ | 36~65% | 45°C |
| G | ~18°C | 66%~ | 50°C |
| H | 19~28°C | 66%~ | 45°C |
| I | 29°C~ | 66%~ | 45°C |

(b) TEMP KEEPING TIME TABLE

| RANGES | TEMP | HMDTY | TIME |
|---|---|---|---|
| A | ~18°C | ~35% | 100 |
| B | 19~28°C | ~35% | 100 |
| C | 29°C~ | ~35% | 100 |
| D | ~18°C | 36~65% | 100 |
| E | 19~28°C | 36~65% | 0 |
| F | 29°C~ | 36~65% | 0 |
| G | ~18°C | 66%~ | 100 |
| H | 19~28°C | 66%~ | 0 |
| I | 29°C~ | 66%~ | 0 |

(a) TARGET TEMP. SETTING TABLE

| RANGES | TEMP | HMDTY | TARGET |
|---|---|---|---|
| A | ~18°C | ~35% | 50°C |
| B | 19~28°C | ~35% | 50°C |
| C | 29°C~ | ~35% | 50°C |
| D | ~18°C | 36~65% | 50°C |
| E | 19~28°C | 36~65% | 45°C |
| F | 29°C~ | 36~65% | 45°C |
| G | ~18°C | 66%~ | 50°C |
| H | 19~28°C | 66%~ | 45°C |
| I | 29°C~ | 66%~ | 45°C |

(b) TEMP KEEPING TIME TABLE

| RANGES | TEMP | HMDTY | TIME |
|---|---|---|---|
| A | ~18°C | ~35% | 100 |
| B | 19~28°C | ~35% | 100 |
| C | 29°C~ | ~35% | 100 |
| D | ~18°C | 36~65% | 100 |
| E | 19~28°C | 36~65% | 0 |
| F | 29°C~ | 36~65% | 0 |
| G | ~18°C | 66%~ | 100 |
| H | 19~28°C | 66%~ | 0 |
| I | 29°C~ | 66%~ | 0 |

FIG.7

| RANGE | TEMP | HMDTY | BASIC TARGET TEMP | TEMP CORRECTION | | | |
|---|---|---|---|---|---|---|---|
| | | | | WIDTH | | | |
| | | | | ~215mm | 215~350mm | 350~700mm | 700mm~ |
| | | | | 8in/A4 | LTR/LGL 10in/B4/A3/A3+ | 14in/B3/16in /A2/A2+ 17in/B2/A1/24in | B1/A0/36in 42in/54in/60ih |
| A | ~18°C | ~35% | 45°C | 0°C | 1°C | 3°C | 5°C |
| B | 19~28°C | ~35% | 45°C | 0°C | 1°C | 3°C | 5°C |
| C | 29°C~ | ~35% | 45°C | 0°C | 1°C | 3°C | 5°C |
| D | ~18°C | 36~65% | 45°C | 0°C | 1°C | 3°C | 5°C |
| E | 19~28°C | 36~65% | 40°C | 0°C | 1°C | 3°C | 5°C |
| F | 29°C~ | 36~65% | 40°C | 0°C | 1°C | 3°C | 5°C |
| G | ~18°C | 36%~ | 45°C | 0°C | 1°C | 3°C | 5°C |
| H | 19~28°C | 36%~ | 40°C | 0°C | 1°C | 3°C | 5°C |
| I | 29°C~ | 36%~ | 40°C | 0°C | 1°C | 3°C | 5°C |

FIG.11

INK JET RECORDING APPARATUS, AND METHOD FOR CONTROLLING RECORDING HEAD TEMPERATURE

FIELD OF THE INVENTION AND RELATED ART

The present invention relates to an ink jet recording apparatus, which records by jetting ink droplets onto recording medium. It also relates to a method for controlling the temperature of an ink jet recording head.

As an image forming apparatus which records on recording medium such as paper, OHP sheet, etc., various image forming apparatuses which employ one or more recording heads have been proposed. There are various recording methods for a recording head, for example, recording methods of the wire dot type, thermal type, thermal transfer type, ink jet type, etc. A recording apparatus which uses an ink jet recording method (which hereafter will be referred to as ink jet recording apparatus) directly jets ink from its recording head onto recording medium. Therefore, it is low in operational cost, and is superbly quiet during a recording operation.

An ink jet recording head has multiple nozzles through which ink droplets are jetted. It has been known that the performance of an ink jet recording apparatus is affected by ink temperature. That is, the properties, more specifically, diameter, which the ink in the recording head will have as it is jetting out in the form of an ink droplet, is affected by the ink temperature. Further, in the case of a recording apparatus which uses thermal energy to jet ink, it does not occur that all of energy given to ink works for jetting ink. In other words, a certain portion of the thermal energy given to the ink in an ink jet recording head to cause the ink to jet out of the recording head remains stored in a recording head, accumulating therein. Therefore, an ink jet recording head tends to increase in temperature if it is continuously used. This fact has also been known. As an ink jet recording head increases in temperature, it changes in the amount by which each of its nozzles jets ink per jetting, which will result in a change in the diameter of the dot each ink droplet will form as it lands on recording medium. The change in the diameter of each dot changes an image in density. Thus, it is possible that as an ink jet recording apparatus is continuously used, it changes in the density level at which it forms an image. Further, when the ink in an ink jet recording head is low in temperature, it is low in viscosity. Thus, when the temperature of an ink jet recording head is low, the ink therein is low in viscosity, and therefore, the ink is not going to be normally jetted at the beginning of a recording operation, sometimes causing the ink jet recording head to form an unsatisfactory image. Thus, in order to enable an ink jet recording apparatus to yield a satisfactory image from the very beginning of a recording operation, the ink jet recording apparatus is controlled in recording head temperature before the recording operation is started.

Registered Japanese Patent 2731274 discloses a technology for controlling the temperature of an ink jet recording head. According to this technology, after an ink jet recording apparatus is turned on, its ink jet recording head is heated to a preset temperature level, at which the temperature of the recording head is kept until recording signals begin to be inputted. Then, as soon as recording signals begin to be inputted, the recording head is heated in such a manner that the temperature of the recording head virtually instantly increases to the final level at which the recording head temperature should be, before the actual recording begins. This document discloses another technology for controlling the temperature of an ink jet recording head. This technology is for solving the problem that, because the increase in the recording head temperature caused by a heater of a large capacity is too rapid relative to the response time of a recording head temperature detecting device, the recording head becomes nonuniform in temperature. According to this technology, an ink jet recording apparatus is provided with two heaters for heating the recording head. One of the heaters is placed in the adjacencies of the openings of the ink nozzles, and the other is placed in the adjacencies of the temperature sensor. The two heaters are placed in the adjacencies of where the nozzles are open. Further, the two heaters are used, individually or in combination, according to the reason for heating the recording head.

If a heating element of the recording head of an ink jet recording apparatus is controlled to very quickly generate a large amount of heat to increase the temperature of the recording head to a preset level before the start of a recording operation, the portion of the recording head, which is immediately next to the heating element becomes different in temperature from the portion of the recording head, which is not next to the heating elements. This is a problem. That is, the portion of the recording head, which is not next to the heating element, sometimes fails to reach the temperature level at which proper recording is possible, by the time the portion of the recording head, which is next to the heating element reaches the temperature level at which proper recording is possible. If an image begins to be recorded while the recording head is in the above described condition, that is, before the entirety of the recording head is heated to the proper temperature level, it is possible that the recording head will fail to properly jet ink, and therefore, an unsatisfactory image will be yielded.

On the other hand, there was the problem that when an attempt was made to control the heating element so that it very quickly generates a large amount of heat to very quickly increase the temperature of the entirety of the recording head to the proper level for recording, the portion of the recording head, which is next to the heating element, became excessively high in temperature. If a recording operation is started while the ink jet recording head is in this condition, the recording head fails to be fully refilled for continuously jetting ink, because the amount by which ink is jetted by an ink jet recording head increases as the recording head temperature increases. Thus, as the recording operation continues, the amount by which ink is jetted per jetting by the recording head gradually reduces to an unsatisfactory level. If the heaters for jetting ink are also used as the means for heating the recording head immediately before the start of a recording operation, closer attention must be paid to this problem.

One of the methods for ensuring that both the temperature of the portion of the recording head, which is next to the heating element, and the temperature of the portion of the recording head, which is not next to the heating element, rise to a preset level virtually at the same time is to gradually heat a recording head by using less intensive pulse to drive the heating elements. This method, however, requires a long time to ensure that the temperatures of both the abovementioned portions of the recording head, which are next to, and not next to, the heating element, rise to the preset temperature level at the same time. Thus, this method is problematic in that it reduces an ink jet recording apparatus in throughput.

Another method for ensuring that the entirety of an ink jet recording head becomes uniform in temperature at a preset level before the start of a recording operation is to heat the recording head to the preset temperature level immediately after the recording apparatus is turned on, and then, keep the temperature of the recording head at this level until recording signals begin to be inputted. This method, however, is problematic in that it increases the amount of electric power consumed while the recording apparatus is kept on standby until recording signals begin to be inputted.

SUMMARY OF THE INVENTION

The present invention was made to solve the above described problems, which the methods, in accordance with the prior art, for controlling the recording head temperature before the start of a recording operation have, and its primary object is to provide an ink jet recording apparatus which forms high quality images from the very beginning of a recording operation while being just as high in throughput as an ink jet recording apparatus in accordance with the prior art, and the method for forming high quality images from the very beginning of a recording operation without reducing an ink jet recording apparatus in throughput.

According to an aspect of the present invention, there is provided an ink jet recording apparatus for effecting recording using a recording head for ejecting ink, said ink jet recording apparatus comprising heating means for heating said recording head; detecting means for detecting a temperature of said recording head; setting means for setting a target temperature of said recording head, control means for controlling the target temperature of said recording head at or above a target temperature; wherein said control means controls the temperature by heating control for heating said recording head and by diffusing control for diffusing the heat supplied by the heating control.

According to another aspect of the present invention, there is provided an ink jet recording apparatus for effecting recording using a recording head for ejecting ink, said ink jet recording apparatus comprising heating means for heating said recording head; detecting means for detecting a temperature of said recording head; and control means for effecting different temperature controls to provide a predetermined temperature of said recording head prior to start of the recording operation.

According to a further aspect of the present invention, there is provided a temperature control method for a recording head for effecting recording by ejecting ink, comprising a heating step of heating said recording head; a detection step of detecting a temperature of said recording head; a setting step of setting a target temperature of said recording head; and a control step of controlling a temperature of said recording head at or above a target temperature, wherein said control step controls the temperature by heating control for heating said recording head and by diffusing control for diffusing the heat supplied by the heating control.

According to a further aspect of the present invention, there is provided a temperature control method for a recording head for effecting recording by ejecting ink, comprising a heating step of heating said recording head; a detection step of detecting a temperature of said recording head; control means for effecting different temperature controls to provide a predetermined temperature of said recording head prior to start of the recording operation; and control means for effecting different temperature controls to provide a predetermined temperature of said recording head prior to start of the recording operation.

The present invention, which is related to the temperature control of a recording head, makes it possible to quickly increase the recording head temperature to a desired level without creating the problems attributable to the overheating of the recording head. Thus, it makes it possible to provide a recording apparatus which forms images of excellent quality from the very beginning of a recording operation, regardless of ambient conditions, without declining in productivity.

These and other objects, features, and advantages of the present invention will become more apparent upon consideration of the following description of the preferred embodiments of the present invention, taken in conjunction with the accompanying drawings.

BRIEF DESCRIPTION OF DRAWINGS

FIGS. 7(*a*) and 7(*b*) are tables for setting the target value for the recording head temperature, and the target value for the length of time the recording head temperature is maintained at a preset level, respectively.

FIG. 11 is a table for setting the target values for the recording head temperature, in the third embodiment of the present invention.

DETAILED DESCRIPTION OF THE PREFERRED EMBODIMENTS

Hereinafter, the preferred embodiments of the present invention will be described in detail with reference to the appended drawings.

<General Description of Recording Apparatus>

First, a typical ink jet recording apparatus to which the present invention is applicable will be described regarding its general structure and operation.

Figure 1:
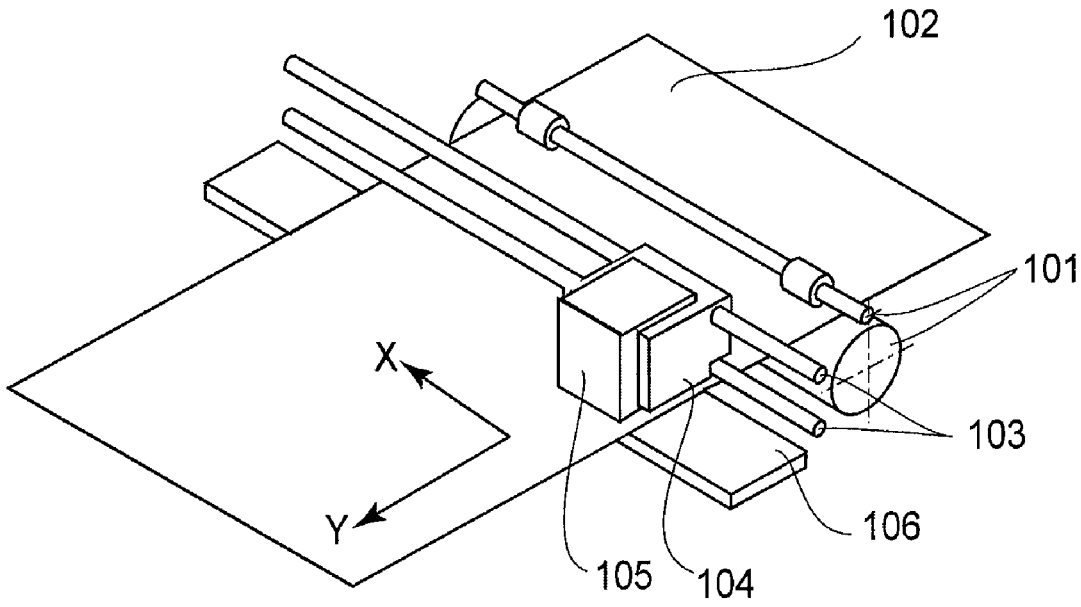
FIG. 1 is a perspective view of the ink jet recording apparatus in the first embodiment of the present invention.

FIG. 1 is a schematic drawing of the entirety of the typical ink jet recording apparatus to which the present invention is applicable.

Referring to FIG. 1, the ink jet recording apparatus is structured so that a recording medium 102 is pinched by the paper conveyance roller 101, and the pair of rollers which oppose the paper conveyance roller 101. As the paper conveyance roller 101 is rotated, the recording medium 101 is conveyed in the secondary scan direction, or the direction indicated by an arrow mark Y in the drawing. The recording head 105 is removably attached to the carriage 104. It is provided with multiples nozzles from which ink droplets are jetted; the opening of each nozzle is at the surface of the recording head 105, which faces the platen. The carriage 104 is reciprocally movable in the primary scan direction, or the direction indicated by an arrow mark X, by an unshown carriage driving means, while being guided by the primary carriage guides 103. As the recording head 105 on the carriage 104 jets ink droplets while the carriage 104 is moved relative to the recording medium 102 in a manner to scan (which hereafter will be referred to as primary scan) the recording medium 102, an image is effected on the recording medium 102. The recording head 105 is connected to an ink container in which ink is stored, or an ink supplying apparatus, so that the recording head 105 is supplied with the ink from the ink container or ink supplying apparatus. The platen 106 is located below the recording head 105. It is long enough to reach one end of the recording range of the recording head 105 to the other. The distance between the recording head 105 and platen 106 is such that when the recording medium 102 is on the platen 106, the gap between the recording medium 102 and recording head 105 is proper for recording.

Although not shown in FIG. 1, this ink jet recording apparatus is provided with a recording medium feeding means, which feeds the recording medium 102 into the recording apparatus so that the recording medium 102 can be conveyed further by the paper conveyance roller 101. It is also provided with: a recovery means for keeping the recording head 105 in the proper condition for jetting ink, and/or restoring the recording head 105 in ink jetting performance; and a recording medium discharging means for discharging the recording medium 102 out of the ink jet recording apparatus after the completion of the recording of an image on the recording medium 102 by the recording head 105. There are various recovering means: a capping means which covers the surface of the recording head 105, which has the nozzle openings, a cleaning means which wipes clean the surface of the recording head 105, which has the nozzle openings, a suctioning or pressurizing means which removes the ink in the recording head 105, a preparatory ink jetting means which causes the recording head to jet ink droplets which do not contribute to the actual recording of an image (recording operation based on image data). These recovering means are effective for keeping the ink jetting performance of the ink jet recording head (apparatus) stable at a satisfactory level.

The recording operation of the ink jet recording apparatus shown in FIG. 1 is as follows:

As the ink jet recording apparatus 105 receives a recording start command (signal) from an external apparatus (host computer or the like) connected to the ink jet recording apparatus 105, one of the recording mediums 102 is conveyed from the upstream side of the recording apparatus, in terms of the secondary scan direction, by the recording medium feeding-and-conveying means, until the leading edge of the recording medium 102 reaches the location of the paper conveyance roller 101. Then, the recording medium 102 is conveyed further by the paper conveyance roller 101, in response to a recording signal, so that the recording start point on the recording medium 101 lines up with the recording head 105. Then, the recording head jets ink while the carriage on which the recording head is borne is moved in the primary scan direction. As a result, a part of the intended image is effected on the recording medium 102. Then, the recording medium 102 is conveyed forward by a preset distance by the paper conveyance roller 101 (hereafter, this conveyance of recording medium by paper conveyance roller will be referred to as recording medium conveyance operation). Then, the recording head 105 jets ink while the carriage on which the recording head 105 is borne is moved in the primary scan direction. This operation for causing the recording head to jet ink while it is moved in the primary scan direction by the carriage, and the abovementioned recording medium conveyance operation, are alternately repeated until the entirety of the intended image is effected on the recording medium 102. Thereafter, the recording medium 102 is discharged from the downstream side of the ink jet recording apparatus, in terms of the secondary scan direction. Ordinarily, paper is used as the recording medium. However, recording media other than paper may be used as the recording medium 102. For example, an OHP sheet, a compact disc, etc., may be used. Moreover, in the case of a DNA chip manufacturing apparatus or a display manufacturing apparatus, which employs an ink jet head, any substance may be used as the recording medium 102 as long as the substance is suitable as the material for the substrate.

Figure 2:
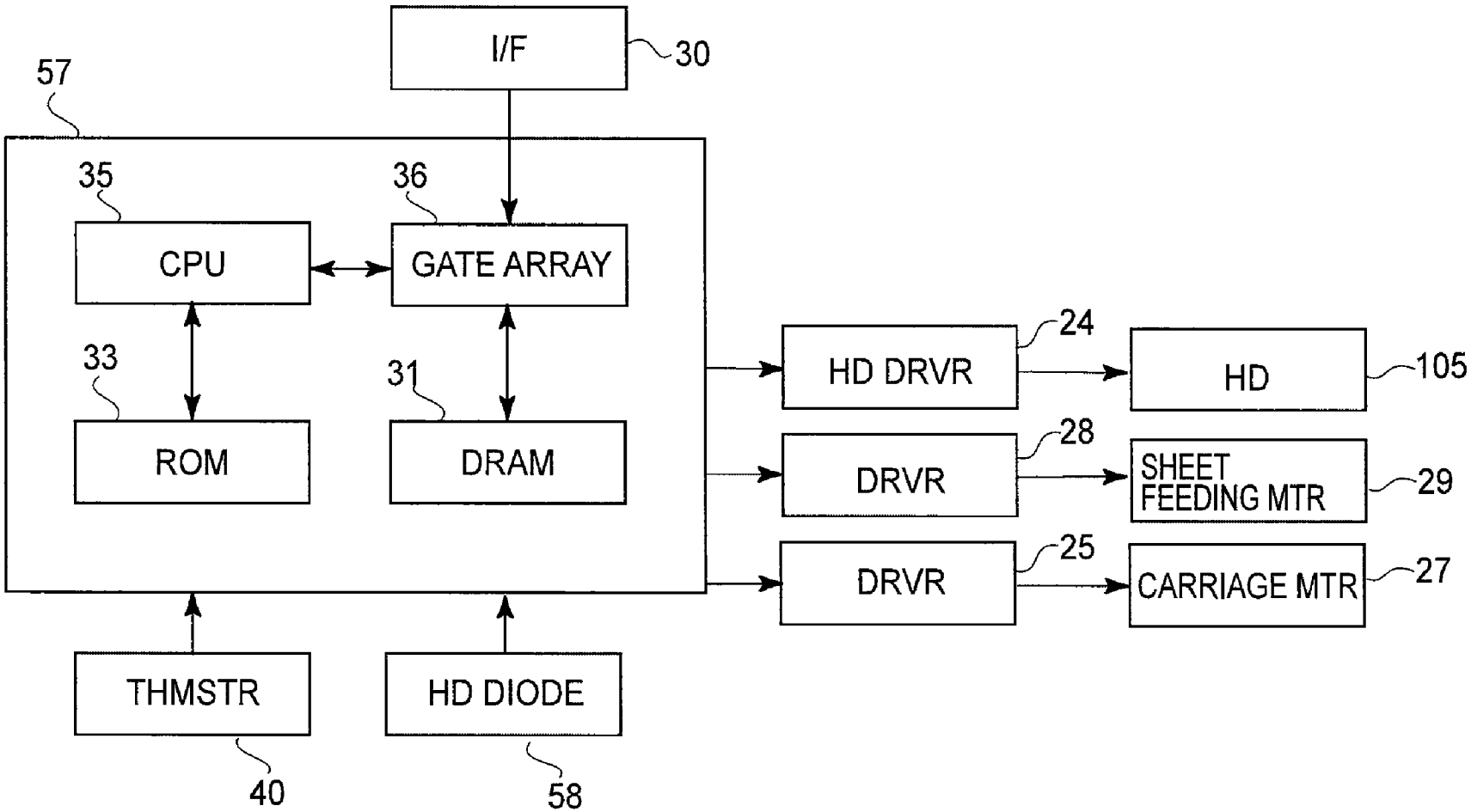
FIG. 2 is a block diagram of the control system of the ink jet recording apparatus in the first embodiment.

FIG. 2 is a block diagram of the control system of the recording apparatus.

As will be evident from FIG. 2, the control system 57 has an internal interface 30, which interfaces between a printer (recording apparatus 105) and a host computer. The interface 30 is provided with a signal path through which it receives recording data and commands from the host computer. The ROM 33 stores the control programs which are carried out by the CPU 35. The DRAM 31 stores various data while the CPU 35 carries out the programs in the ROM 33. It also stores the recording data to be supplied to the recording head 105. The gate array 36 controls the recording data which are sent from the RAM 31 to the recording head 105. It also controls the data transfer among the interface 30, CPU 35, and RAM 31.

The carriage motor driver 25 drives the carriage motor 27 in order to move the recording head 105 to the preset recording point in the recording range in terms of the primary scan direction in response to the signals which are outputted from the control system 57 (or CPU 35). Similarly, the recording head driver 24 drives and controls the recording head 105, and the paper conveyance motor driver 28 drives and controls the paper conveyance motor 29, in order to record an image on the recording medium 102 and conveys the recording medium 102.

Further, the gate array 36 and CPU 35 of this control system 57 receive the recording signals, such as picture data and control commands, from the host computer through the interface 30, and convert the received recording signals into recording data. Then, they store the recording data in the RAM 31. Further, the control system 57 synchronously drives the motor drivers 24, 25, and 28 to make the recording head 105 carry out a recording operation, to make the paper conveyance roller convey the recording medium 102, and also, to make the carriage (recording head 105) reciprocally move in the primary scan direction so that an image is effected on the recording medium 102.

The ink jet recording apparatus in this embodiment of the present invention jets ink by generating thermal energy for boiling the ink, by driving the electrothermal transducing element in each of the multiple nozzles of the recording head 105 in response to the electrical signals which are sent from the head driver 24. The amount by which ink is jetted per jetting from each of the nozzles of the recording head 105 is affected by the temperature of the recording head 105. Therefore, it is very important to know the temperature of the recording head 105. Thus, the recording apparatus is provided with a thermistor 40 for measuring the ambient temperature of the recording apparatus (which may be called environmental temperature), and a head diode 58 for measuring the recording head temperature. Both are calibrated at the beginning. Incidentally, the recording apparatus may be provided with a sensor capable of measuring the humidity as well as temperature, instead of the thermistor 40 which measures only the environmental temperature. It may be outside the recording apparatus, or relatively close to the recording head, for example, on the carriage, where the thermistor 40 is positioned. Moreover, the recording apparatus may be set up so that the environmental temperature is estimated based on the temperature detected by the head diode located near the nozzle openings of the recording head.

Figure 3:
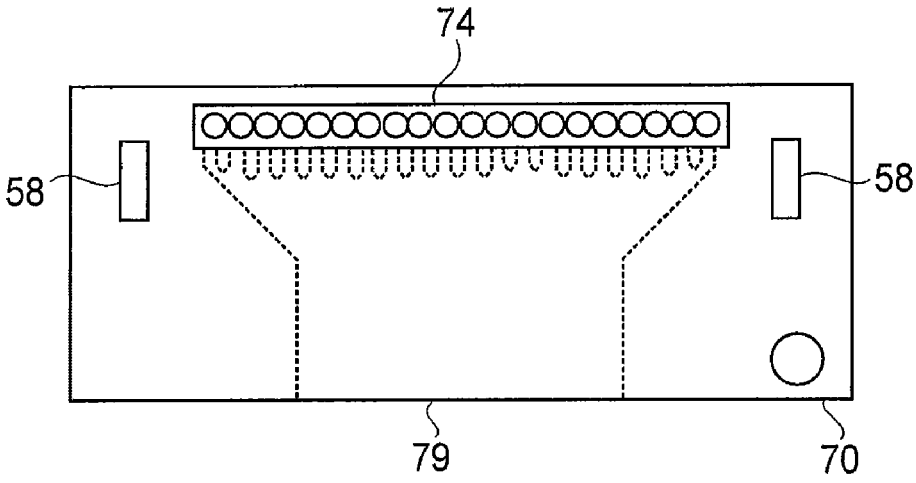
FIG. 3 is a schematic drawing of the recording head in the first embodiment of the present invention.

FIG. 3 is a schematic drawing of the recording head 105.

FIG. 3 is a drawing for conceptually describing the heater board 70 of the recording head 105, which is on the silicon wafer, and ink jetting nozzles which are on the heater board 70. The heater board 70 is shared by the multiple rows of ink nozzles (or nozzle groups) of the recording head 105, which are different in the color of the ink they jet. Thus, for the sake of simplification, only a single row of ink nozzles is shown.

There are multiple heating elements on the heat board 70. The heating elements are arranged so that they are in the ink nozzles (which may be referred to simply as nozzles), one for one. Incidentally, in FIG. 3, the entirety of the multiple heating elements (heaters) which are in the nozzles, one for one, is designated with a referential number 74. In order to make it easier to conceptually understand the ink jet recording system, FIG. 3 shows a smaller number of ink nozzles, which are represented by small circles, than the actual number. That is, some ink jet recording heads have as many as 1,280 nozzles per color (per row). Designated by a referential number 79 is a common ink chamber through which ink is supplied to each nozzle. The common ink chamber 79 also serves as an ink storage chamber in which the ink to be supplied to each of the nozzles is stored.

In this embodiment, the recording head 105 is provided with a pair of head diodes 58 for measuring the temperature of the recording head. The head diodes 58 are located near the ends of the recording head 105, in terms of the direction in which the openings of the nozzles of each nozzle row are aligned. The recording head 105 is heated by driving the heating elements in the nozzles in such a manner that the amount of heat generated by the heating elements is not enough to cause ink to be jetted, but is enough to heat the recording head.

The primary characteristic of the present invention is that the present invention makes it possible to heat a recording head before the starting of a recording operation, in such a manner that the ink in the adjacencies of the heating elements, the ink in the common ink chamber, and the ink in the ink passages, increase in temperature to a proper level for a recording operation, without making the recording head temperature excessively high.

<Temperature Control of Recording Head>

Figure 4:
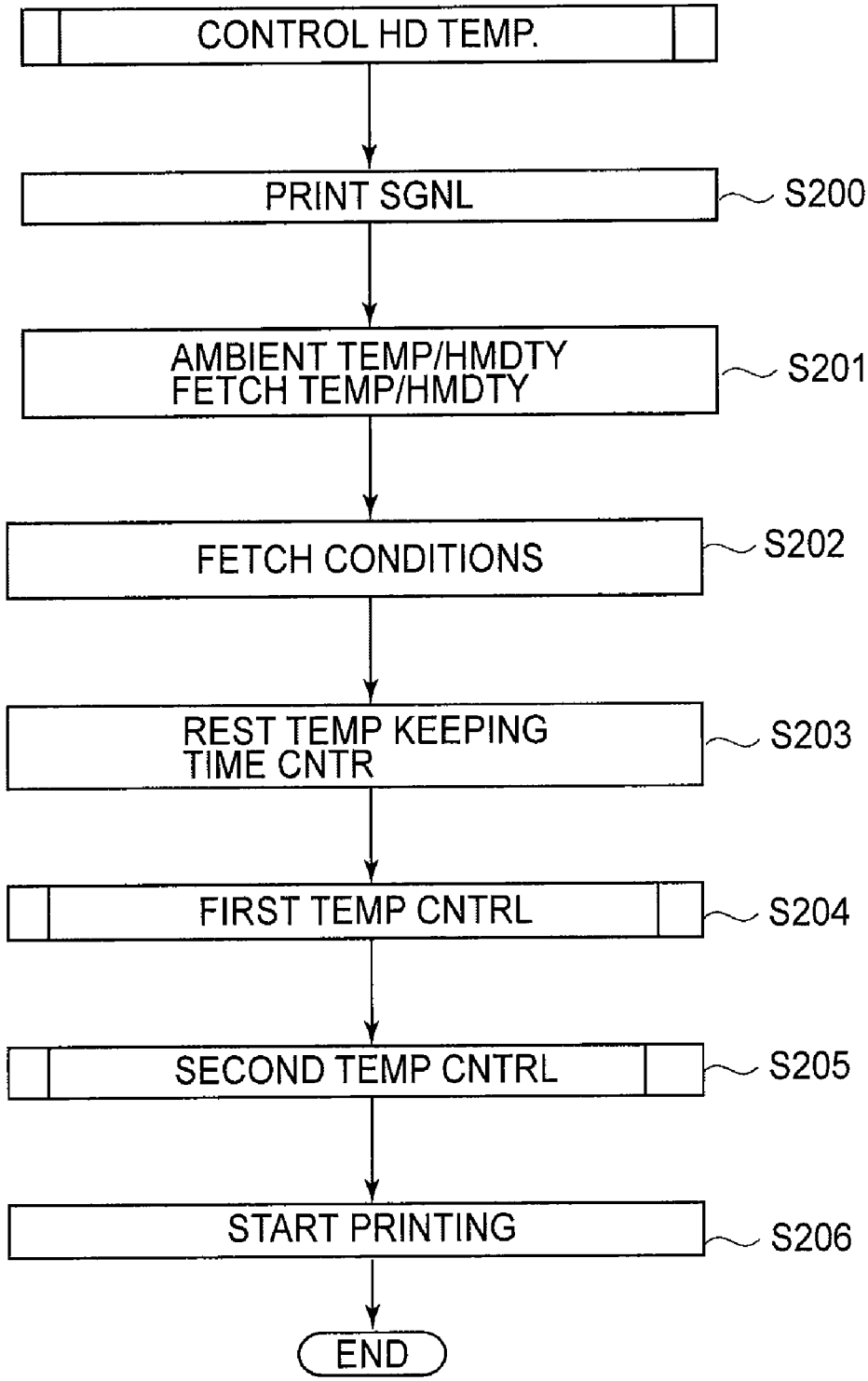
FIG. 4 is a flowchart of the recording head temperature control sequence to be carried out before the start of a recording operation, in the first embodiment.

FIG. 4 is a flowchart of the pre-operational recording head temperature control sequence, which characterizes the present invention.

As a recording signal is detected in Step S200, the ambient humidity (environmental humidity) of the recording apparatus is obtained in the following step (S201). Then, the conditions which need to be set for the first and second temperature control stages are obtained in Step S202. These conditions for the first and second temperature control stages are: the target temperature level for each of the two operations; pulse specification for each of the two operations; and the length of the second temperature controlling operation. In the next step (S203), the counter for measuring the length of time the recording head temperature is maintained at a preset level is reset. Then, the steps (Step 204 and Step 205) in the pre-operational recording head temperature control sequence, which characterize the present invention, are carried out in succession. Thereafter, a recording operation is started in Step S206.

Incidentally, adding a pre-jetting step, that is, a step in which ink is jetted for a preparatory purpose, between the second temperature controlling sequence (Step S205) and the starting of a recording operation is useful to ensure that ink is satisfactorily jetted from the very beginning of a recording operation, although this pre-jetting step is not shown in FIG. 4.

Hereafter, the present invention, which relates to the first and second temperature control stages in the pre-operational recording head temperature control sequence, will be described in detail with reference to the preferred embodiments of the present invention. The various values set in the following preferred embodiments of the present invention are simply examples, and are not intended to limit the present invention in scope.

Embodiment 1

Figure 5:
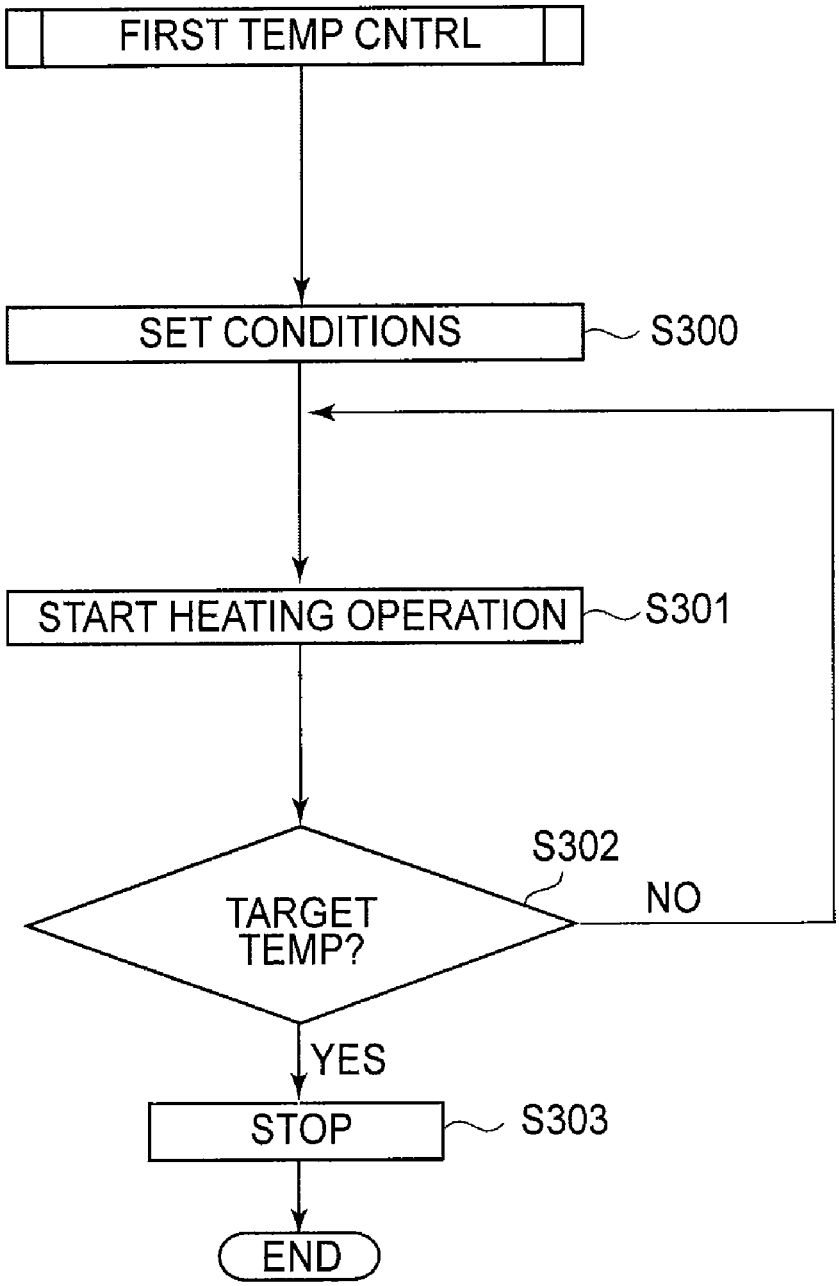
FIG. 5 is a flowchart of the first temperature control stage in the recording head temperature control sequence in the first embodiment of the present invention.
Figure 6:
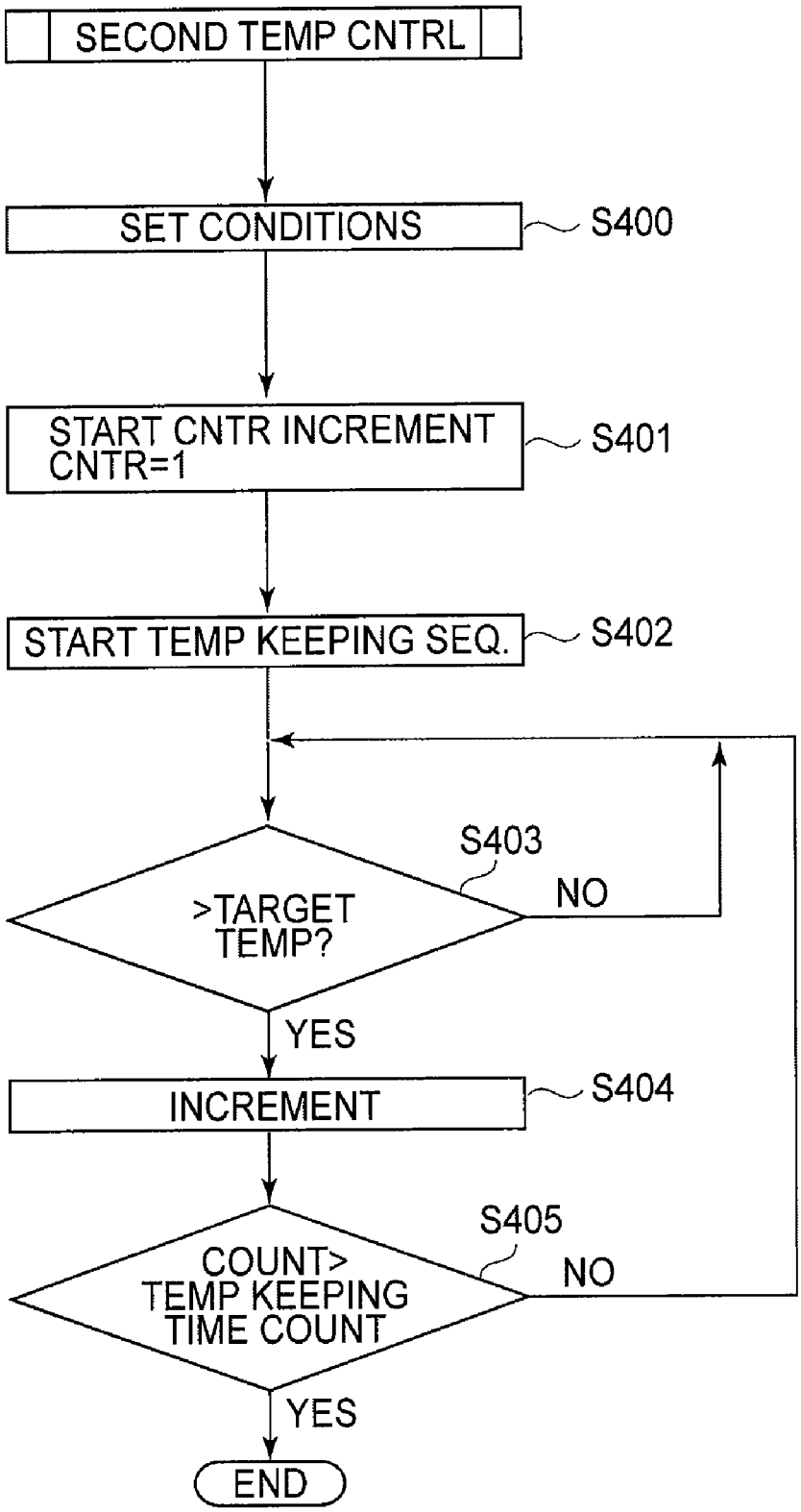
FIG. 6 is a flowchart of the second temperature control stage in the recording head temperature control sequence in the first embodiment of the present invention.

In this embodiment, the first temperature control stage is the stage for continuously heating the recording head until the recording head temperature reaches the target level, that is, the temperature level to which the recording head temperature needs to reach before the start of a recording operation. The second temperature control stage is the stage for allowing the heat provided in the first temperature control stage to spread to make uniform in temperature the entirety of the recording head, including the portion of the recording head in the adjacencies of the heating elements. If necessary, the heating elements are driven to maintain the temperature of the recording head at the target level, even in the second temperature control stage which comes after the temperature of the portion of the recording head in the adjacencies of the heating elements reaches the target temperature. FIGS. 5 and 6 are flowcharts of the first and second temperature control stages in this embodiment of the present invention.

Referring to FIG. 5, first, various conditions necessary for the first temperature control stage are set in Step S300, according to the environmental information, more specifically, ambient temperature and humidity, obtained in Step S201 in FIG. 4. More specifically, the proper value for the target temperature level for the second temperature control stage is obtained based on Table A in FIG. 7, which shows the relationship among the environmental temperature and humidity, and the target temperature, and the obtained environmental temperature and humidity information. Then, the target temperature level for the second temperature control stage is set to this value. This table which shows the relationship among the temperature, humidity, and target temperature is stored in the ROM (memory) 33. The temperature level selected in this step is the temperature level at which the temperature of the recording head needs to be before the starting of a recording operation. Next, the values for the parameters of the pulse which is to be applied to drive the heating element to heat the recording head to the target temperature level are set. Then, in Step S301, the heating elements of the recording head are driven, using the pulses specified in the preceding step, so that the temperature of the recording head increases to the target temperature level. In Step S302, the temperature of the recording head is detected by the head diode, and then, it is determined whether or not the temperature of the recording head has reached the target level. If it is determined that the temperature of the recording head has not reached the target level, the control stage returns to Step S301, in which the heating elements are continuously driven. On the other hand, if it is determined in Step S302 that the temperature of the recording head has reached the target level, the driving of the heating elements is stopped in the following step, or Step S303, ending thereby the first temperature control stage. As soon as the first temperature control stage ends, the second temperature control stage is started.

The first temperature control stage simply increases the temperature of the portion of the recording head in the adjacencies of the heating elements, to the target level. Thus, after the heating of the recording head through the first temperature control stage, the temperature of the ink in the ink chamber located a small distance away from the heating elements is lower than the target level. In other words, the recording head is nonuniform in temperature. If a recording operation is started when the recording head is in this condition, the recording head fails to continuously jet ink in a proper manner; the recording head fails to satisfactorily perform. In order to enable the recording head to satisfactory perform even when the recording head is nonuniform in temperature, it is necessary to continuously heat the recording head as it is in an ink jet recording apparatus in accordance with the prior art. In order to continuously heat the recording head even after the temperature of the portion of the recording head in the adjacencies of the heating elements, the target temperature level must be set to a value higher than the proper value. If the target temperature level is set to a value higher than the proper value, it is possible that the portion of the recording head in the adjacencies of the heating element will be overheated, and therefore, the recording head will fail to satisfactorily jet ink.

In this embodiment, therefore, in order to enable the recording head to satisfactorily jet ink from the beginning of a recording operation without increasing the temperature of the recording head to a level higher than a proper level, the recording head is made uniform in internal temperature by the second temperature control stage which is carried out immediately after the end of the first temperature control stage.

Referring to FIG. 6, first, various conditions necessary for the second temperature control stage are set in Step S400, according to the environmental temperature and humidity information obtained in Step S201 in FIG. 4. More specifically, the value for the target temperature level, value for the length of time the recording head temperature is to be maintained at a preset level, and values for the parameters of the heating element driving pulse, for the second temperature control stage, are selected, based on the environmental temperature and humidity information obtained in Step S201, and Table B in FIG. 7, which shows the relationship among the environmental temperature and humidity, and the length of time the recording head temperature is to be maintained at a preset level. Then, the target temperature level, the length of time the recording head temperature is to be maintained at the preset level (which hereafter will be referred to length of temperature maintenance), and the parameters of the heating element driving pulse are set to the selected values. This table which shows the relationship among the temperature, humidity, and the length of time the recording head temperature is to be maintained at the preset level, is stored in the ROM 33. FIG. 7(*b*) does not include the information regarding the target temperature. In this embodiment, therefore, the target temperature for the second temperature control stage is set to the same value as that for the first temperature control stage. However, the recording apparatus may be configured so that the first and second temperature control stages are different in target temperature level.

Next, the counter for measuring the length of temperature maintenance is turned on, and the routine for keeping constant the temperature of the recording head is started (Steps S401 and S402). Step S402 in this temperature maintaining routine is such a step that if the recording head temperature, which is continuously obtained, is higher than the target temperature level, the heating of the recording head is stopped, and if the recording head temperature is lower than the target level, the driving of the heating elements is continued or restarted as long as the second temperature control stage is continued. If it is determined in Step S400, in which the recording head temperature detected by the head diode 58 is compared to the target temperature level, that the detected recording head temperature is lower than the target level, the heating elements are driven by the abovementioned temperature maintaining routine. If it is determined in Step S403 that the detected temperature is higher than the target level, the counter for recording the duration of the temperature maintaining routine is increased in value (counted up) in the following step, or Step S404. Then, in Step S405, it is determined whether or not the length of the duration of the temperature maintaining routine, which is shown in the counter, is greater than a preset value. When the value (temperature maintaining routine duration count) in the counter is no greater than the preset value, the second temperature control stage reverts to Step S403. If it is determined that the value in the counter is no less than the preset value, the second temperature control stage is ended, and the recording operation shown in FIG. 4 is started (Step S406). In this embodiment, the recording head is set up so that instead of measuring the length of time the temperature maintaining routine is continued since the beginning of the second temperature control stage, the number of times it is determined that the recording head temperature is higher than the target level is counted. With the employment of this setup, it is possible to maintain the recording head temperature at the preset level for a proper length of time regardless of the ambience of the recording apparatus. Although, in this embodiment, the number of times the recording head temperature is found to be higher than the target level is counted, the length of time the recording head temperature is found to be higher than the target level, that is, the length (preset length) of time the recording head temperature is kept at the temperature level at which the recording head can properly jet ink, can be obtained because the steps S404-S405 are carried out with preset intervals.

FIG. 7 shows the examples of the values to which the various parameters are set in the steps in the flowcharts in FIGS. 5 and 6. FIG. 7(*a*) is a table to be used for setting the target temperature value according to the environmental conditions, and FIG. 7(*b*) is a table to be used for setting the target value for the length of time the temperature maintaining routine is to be continued, according to the environmental conditions.

Referring to FIG. 7, the values for the target temperature level are set according to the various combinations between the environmental temperature ranges (-18° C./19-28° C./29° C.-) and humidity ranges (-35%/36-65%/66%-). The values provided in FIG. 7(*b*) for the length of the temperature maintaining routine do not represent the actual length of time, but the number of times the recording head temperature is found to be higher than the target level, concurring with the second temperature control stage shown in FIG. 6. The interval with which the recording head temperature is read during this temperature control stage is set to 30 ms. Thus, when the environmental condition is in Combination A, for example, the duration of the temperature maintaining routine is slightly longer than 3 seconds.

Figure 8:
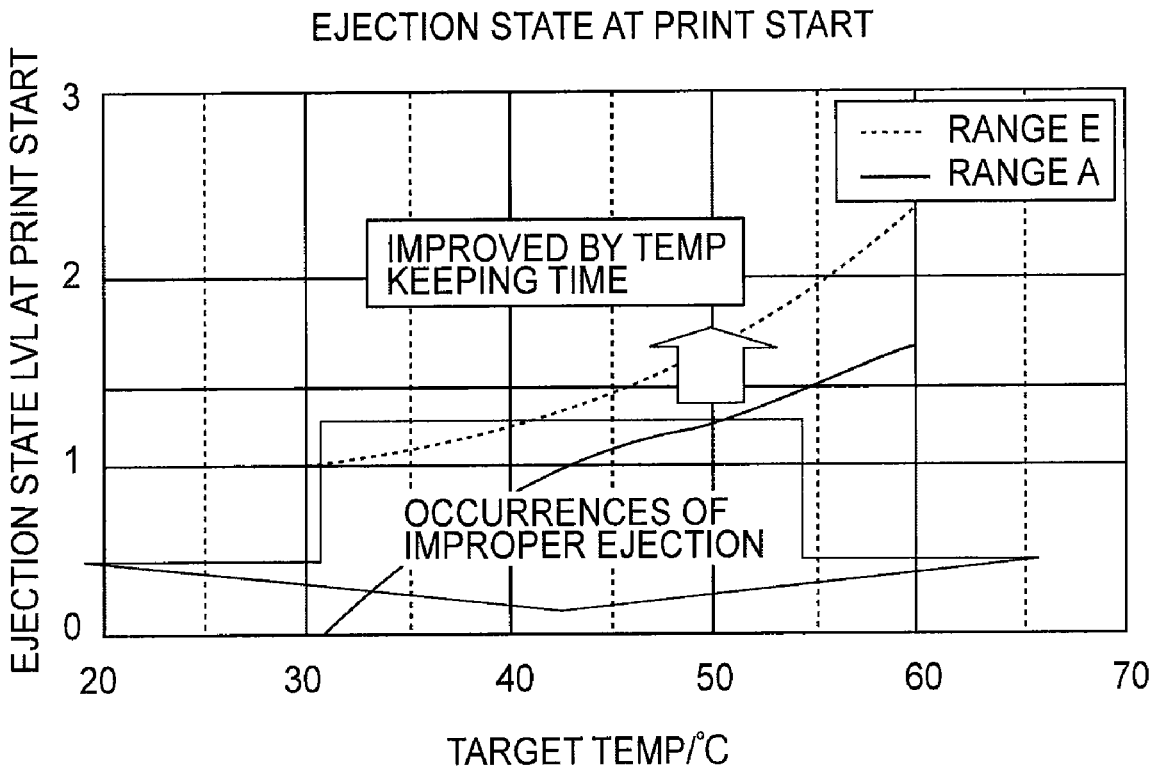
FIG. 8 is a graph showing the relationship between the temperature of an ink jet recording head and the ink jetting performance of the ink jet recording head.

FIG. 8 shows the relationship between the recording head temperature and the ink jetting performance of the recording head. This relationship is used to create the tables in FIG. 7.

Referring to FIG. 8, the horizontal axis represents the recording head temperature, and the vertical axis represents the ink jetting performance of the recording head at the beginning of a recording operation. The bold black line represents an ink jetting performance level of 1.4, which is the borderline level. That is, if the ink jetting performance of the recording head is no higher than 1.4, it is determined that the recording head is unsatisfactory in ink jetting performance. The ink jetting performance level is calculated based on the length of time it took for the ink jetting performance of the recording head to decline to a level at which the recording head fails to satisfactorily jet the first ink dot droplet after the completion of the pre-recording operation recording head controlling sequence. The graph shows that the greater the numerical value, the better the ink jetting performance of the recording head at the beginning of a recording operation. The ink jetting performance of the recording head is affected by the ambience of the recording head. Thus, FIG. 8 shows the relationships between the ink jetting performance of the recording head and recording head temperature when the environmental condition of the recording head is Combination A (−18° C./−35% in environmental temperature and humidity), and when it is Combination E (19-28° C./36-65% in environmental temperature and humidity). From FIG. 8, in Condition A, as the recording head temperature is no less than roughly 55° C., the ink jetting performance of the recording head is greater than 1.4, above which the performance is normal. Therefore, when the environmental condition is Combination A, the target temperature level should be set to 55° C. Similarly, when the environmental condition is Combination E, the target temperature level, that is, the temperature level above which the recording head is normal in ink jetting performance, is to be set to 45° C.

However, in the situation in which control must be executed to increase the recording head temperature, there is an undesirable possibility that a problem will occur because the temperature of the recording head becomes excessively high. The studies made by the inventors of the present invention revealed that in the case of a recording head, such as the recording head, the characteristics of which are shown in FIG. 8, if the recording head temperature is higher than 50° C., it tends to form abnormal images at the beginning of a recording operation, which had been known from another study. On the other hand, the studies revealed that even if the target temperature level is the same, that is, 50° C., the provision of the temperature maintaining routine, can improve the ink jetting performance of the recording head, as indicated by an arrow mark in the drawing, without raising the recording head temperature to 55° C. In other words, the problem that an ink jet recording apparatus yields unsatisfactory images because of the excessive increase in the recording head temperature can be prevented by combining the heating operation for increasing the recording head temperature to a target temperature, with the heating operation for maintaining the recording head temperature at the target temperature, instead of abruptly increasing the recording head temperature immediately before the start of a recording operation. The heat given to the recording head before the start of a recording operation is diffused during the temperature maintaining period provided during the control stage referred to as temperature maintenance routine in the present invention. Therefore, the recording head becomes uniform in internal temperature at the target level for the satisfactory jetting of ink, making it unnecessary for the recording head to be heated to a temperature level higher than the target level.

Incidentally, the above described pre-recording operation temperature control sequence is to be carried out for all the recording heads employed by the recording apparatus. However, it was described with reference to only one of the recording heads. That is, in the case of a printer having multiple ink jet recording heads, the above described pre-recording operation head temperature control sequence is carried out for the multiple recording heads at the same time. However, the multiple recording heads will be different in the point of time at which the sequence ends. For the purpose of ensuring that the printer performs at its highest level, it is desired that a recording operation is started after the pre-recording operation head temperature control sequence is completed for all the recording heads. That is, even if the temperature of a given recording head reaches the target level through the first and second temperature control stages, the temperature of this recording head must be maintained at the target level. Therefore, while this recording head is kept on standby, the temperature maintaining routine is desired to be continued for this recording head even after the second temperature control stage for this recording head is completed. Thus, in the case of an ink jet recording apparatus having multiple recording heads, a step in which it is determined whether or not the temperature maintenance counts of all the recording heads have exceeded the target value, must be added as the next step to Step S404 in FIG. 4, before the completion of the second temperature control stage.

The relationship shown in FIG. 8 is affected by what kind of ink is used for a recording operation. Therefore, it is desired that the values for the parameters for the first and second temperature control stages are set according to the characteristics of the ink used for the recording operation. The first and second temperature control stages may be the same or different, in the values of the parameters (voltage, width, frequency, etc.) of the pulse used for driving the heating elements. However, from the standpoint of productivity (shorter in duration of temperature control routine), and/or the prevention of the problem attributable to the excessive heating of a recording head, it is desired that the first and second temperature control stages are different in the values of the parameters of the heating element driving pulse; the values for the parameters are to be switched during the transition from the first temperature control stage to the second so that for the first temperature controlling stage, the parameters are set to more aggressively heat the recording head than in the second temperature control stage, to make the temperature of the recording head quickly rise, whereas for the second temperature control stage the parameters are set to moderately heat the recording head to keep the temperature of the recording head stable at the target level.

Further, it is desired that the values for the parameters (target temperature, temperature maintenance routine duration and/or heating element driving pulse specification) for the first and second temperature control stages are set according to the length of the time having elapsed since the last printing operation. That is, it is reasonable to think that when two recording operations are continuously carried out, the entirety of the recording head is uniform in temperature at a level close to the target temperature level because of the preceding recording operation. In such a case, it is desired that the parameters are set according to the condition of the recording head immediately before the starting of the second recording operation; for example, the recording head temperature maintaining routine is reduced in duration.

Incidentally, in this embodiment, the heating elements used for the first and second recording head temperature control stages are the same as those used for jetting ink. However, the recording head may be provided with heating element dedicated to the heating of the recording head. In the case that the recording head is provided with the heating elements (sub-heaters) dedicated to the heating of the head in addition to the heating elements (primary heaters) for jetting ink, an operational arrangement may be made so that for the purpose of heating the recording head, both the primary and subordinate heaters are used, whereas for the purpose of jetting ink, only the primary heaters are used. Further, the first and second head temperature control stages may be different in the heaters used therefore.

Embodiment 2

Figure 9:
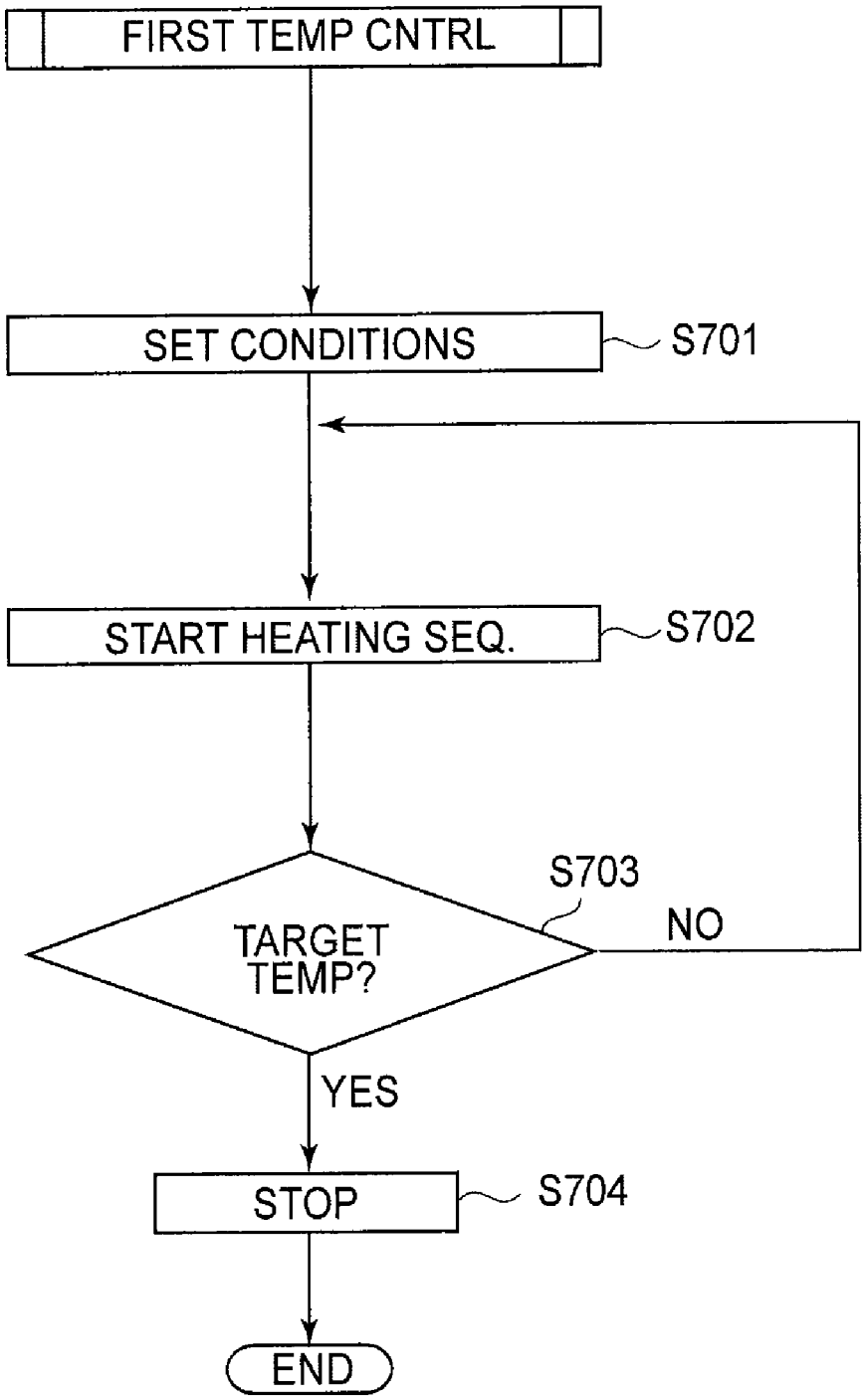
FIG. 9 is a flowchart of the first temperature control stage in the second embodiment of the present invention.
Figure 10:
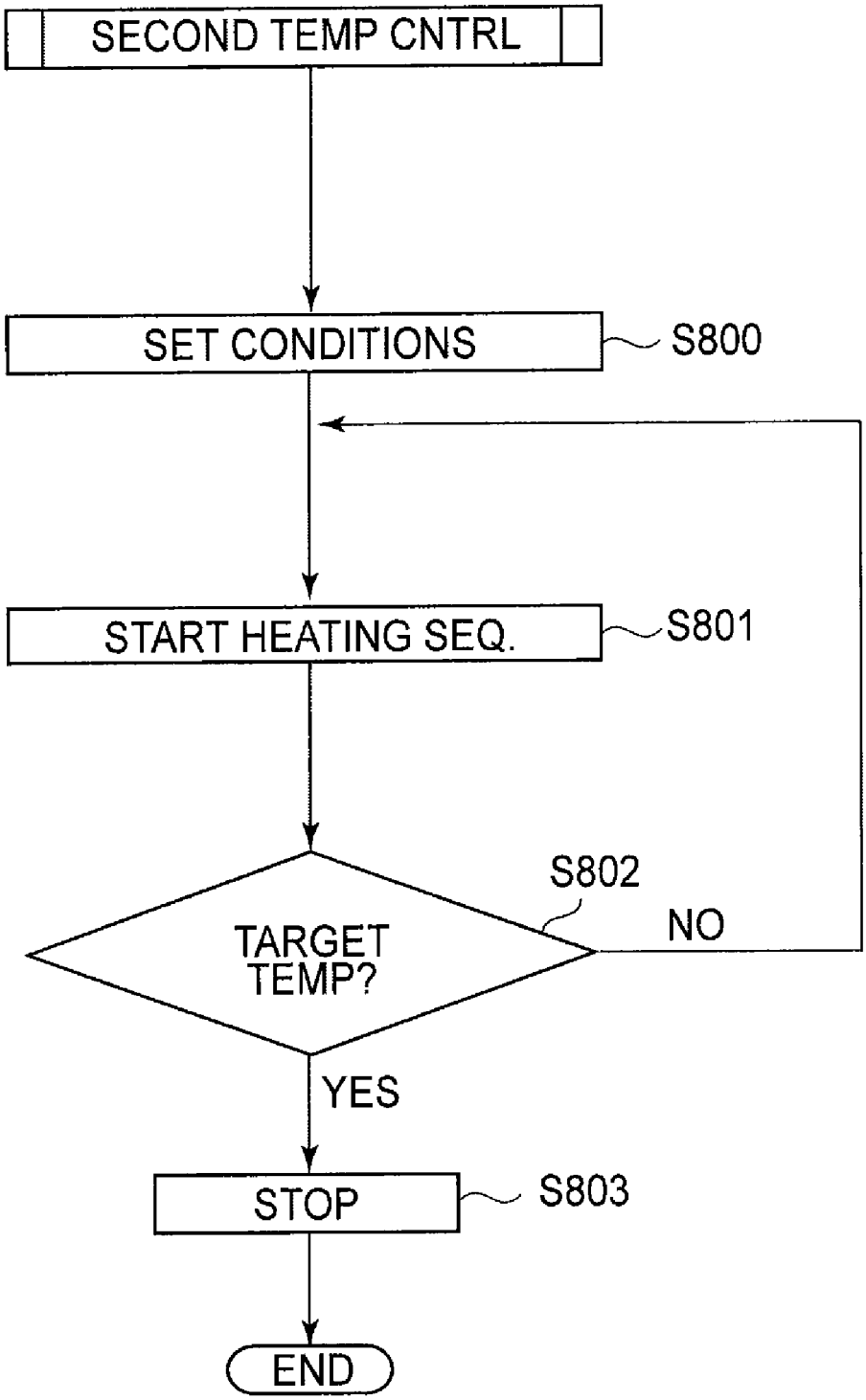
FIG. 10 is a flowchart of the second temperature control stage in the second embodiment of the present invention.

In the first embodiment, in order to achieve two objects of preventing the problem that unsatisfactory images are yielded because of the overheating of the recording head attributable to aggressive heating of the recording head, and preventing the problem that carrying out the first and second head temperature control stages reduces an ink jet recording apparatus in productivity, the first and second head temperature control stages are not differentiated in target temperature level, and the head temperature maintaining routine was provided. In the second embodiment, however, instead of providing the head temperature maintaining routine, the first and second heat temperature control stages are made different in target temperature level, so that the final target temperature level is reached in two stages. More specifically, in the first temperature control stage, the recording head is heated so that its temperature quickly reaches a target temperature level (first temperature level), which is different from the final target level (second temperature level), and in the second temperature control stage, which immediately follows the first temperature control stage, the recording head is gradually heated from the first temperature level to the second temperature level to prevent the recording head from being overheated. FIGS. 9 and 10 are flowcharts of the first and second recording head temperature control stages in the second embodiment, and are for describing the second embodiment.

The first temperature control stage shown in FIG. 9 is not different from the first temperature control stage in the first embodiment, except for the value set for the target temperature level (first temperature level). That is, in the first temperature control stage in this embodiment, in order to increase the recording head temperature in a short time, the parameters of the heating element heating pulse are set in a manner to intensify the pulse, or the target temperature level (first target temperature level) is set to a value higher than the ideal final target level obtainable from FIG. 8 so that the parameters of the heating element driving pulse are set to make the pulse slightly stronger than the pulse used in the first temperature control stage in the first embodiment. The target temperature level (first level) for the first temperature control stage in this embodiment, which is to be set in Step S701, is desired to be as close as possible to the final target value, within a range in which no problem occurs at the beginning of a recording operation.

In the second temperature control stage shown in FIG. 10, the value for the final target temperature level is set, and the parameters of the heating element driving pulse are reset so that the recording heat temperature is more gradually increased until the final target temperature level is reached.

Embodiment 3

In the first embodiment, the target temperature level and duration of temperature maintenance routine are set according to the condition of the ambience of the recording apparatus. However, the recording head temperature fluctuates due to the changes in printing conditions, such as print width, print duty, etc., during a recording operation. Therefore, it is desired that the parameters such as the target temperature level and duration of temperature maintenance routine are reset in response to the changes in the printing conditions such as print width, print duty, etc. In this embodiment, the adjustment is made in response to the changes in print width and print duty. However, for the simplification of description of this embodiment, only the adjustment to be made to the target temperature level will be described.

FIG. 11 is a table which shows the relationship among the basis target temperature levels which correspond to the environmental temperature and humidity levels, and the amounts by which the basis target temperature levels are to be adjusted according to the paper width. The value for each final target temperature level is the total of the basis target temperature value and the adjustment amount. In FIG. 11, four values are provided for the amount by which the target temperature level is preset according to the combination of environmental temperature and humidity ranges is to be adjusted according to recording paper width. When a narrow recording medium (recording paper) is used for a recording operation, the length of time it takes to scan (recording scan) is short. Therefore, the conditions are relaxed for the temperature maintenance routine carried out immediately before the start of a recording operation to ensure that the recording head satisfactorily jets ink per scan. In comparison, in the case of the table in FIG. 7(*a*), which is used in the first embodiment, the target temperature level is set to a value obtainable by adding the adjustment amount, in FIG. 11, for a recording medium (paper) which is no less than 700 mm in width, to the basis target temperature value in FIG. 11, in order to ensure satisfactory ink jetting performance regardless of recording medium (paper) width.

Incidentally, the target temperature values in FIG. 11 are such values that were not calculated in consideration of the estimated print duty in the following scan. In reality, if the section of an image, which is to be printed during the following scan, is high in print duty, not only does the head temperature quickly increase, but also, ink is jetted from the nozzles as the head temperature quickly increases. Therefore, the conditions for temperature maintaining routine can be relaxed. Given below is an example of the mathematical equation for obtaining the amount by which the target temperature level is to be adjusted. The choices of the adjustment method do not need to be limited to the one based on this equation. For example, an adjustment amount table may be provided for each print duty or an equation different from the following one may be used:

$$T = Ta - Tb \times \text{print duty } (\%),$$

wherein, "Ta" stands for the basic adjustment amount for each of different types of recording media (paper), which is adjusted by the "Tb×print duty (%)" to compensate for the difference in print duty. "Tb" stands for the coefficient of temperature requirement relaxation relative to print duty. It may be calculated from the data regarding the relationship between the increase in the recording head temperature and print duty, or may be deduced from the results of the evaluation of the ink jetting performance of the recording head made at the beginnings of a number of recording operations different in print duty. "T" stands for the final amount by which the target temperature level is adjusted for the recording medium (paper) to be used for the following recording operation. In other words, the final target temperature level is set to the value obtained by adding "T" to the basic target temperature value.

As described above, in this embodiment, the recording head temperature is controlled in consideration of the width of the recording medium, and/or print duty. Therefore, the temperature of the recording head remains at a more proper level, enabling thereby the recording head (image forming apparatus) to form an image of higher quality than in the preceding embodiments. Further, recording media different in type are different in ink absorbency. Therefore, some ink jet recording apparatuses are enabled to adjust themselves in the amount by which they make each of their nozzles to jet ink per jetting. In the case of these ink jet recording apparatuses, the manner in which the recording head temperature increases is affected by what type of recording medium is used, and therefore, the type of the recording medium may be taken into consideration as one of the printing conditions when setting a value for the target temperature.

In the above, the first to third preferred embodiments of the present invention were described. However, these embodiments are not intended to limit the present invention in scope. Further, these embodiments may be implemented in combination.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 098006/2006 and 055761/2007 filed Mar. 31, 2006 and Mar. 6, 2007, respectively, which are hereby incorporated by reference.

What is claimed is:

1. An ink jet recording apparatus for effecting recording using a recording head for ejecting ink, said ink jet recording apparatus comprising:

heating means for heating said recording head;

detecting means for detecting a temperature of said recording head;

setting means for setting a target temperature of said recording head;

control means for controlling the temperature of said recording head to be above the target temperature; and timing means for measuring a time period during which the detected temperature of said recording head is above the target temperature, wherein said control means controls the temperature by heating control for heating said recording head above the target temperature and then effecting diffusing control to permit the heat to diffuse in said recording head, and wherein said control means effects the diffusing control during a period from the heating control to a start of a recording operation, and enables the diffusing control until the time period measured by said timing means during which the temperature of said recording head is above the target temperature becomes greater than a predetermined time period.

2. An apparatus according to claim 1, further comprising ambient detecting means for detecting an ambient temperature or humidity, wherein said setting means sets the target temperatures on the basis of the temperature or humidity detected by said ambient detecting means.

3. An apparatus according to claim 2, wherein said heating means heats said recording head using a heating element provided in addition to a heating element for ejecting the ink.

4. An apparatus according to claim 2, wherein said control means provides different driving pulses for the heating control and for the diffusing control.

5. An apparatus according to claim 4, wherein said control means effects a temperature control based on a temperature of said recording head detected by said detecting means and on time required for diffusing the heat supplied by said heating means.

6. An apparatus according to claim 1, wherein said setting means sets different target temperatures for the heating control and for the diffusing control.

7. An apparatus according to claim 1, wherein said setting means sets the target temperature on the basis of a recording condition under which the recording is effected.

8. An apparatus according to claim 7, wherein said apparatus effects the recording on a recording material, and the recording condition includes a width of the recording material.

9. An apparatus according to claim 7, wherein the recording condition includes a recording duty of said recording head.

10. An apparatus according to claim 7, wherein said apparatus effects the recording on a recording material, and the recording condition includes a kind of the recording material.

11. An apparatus according to claim 1, wherein said heating means heats said recording head using a heating element for ejecting the ink.

12. An apparatus according to claim 1, wherein said heating means heats the recording head using a heating element provided in addition to a heating element for ejecting the ink.

13. A temperature control method for a recording head for effecting recording by ejecting ink, comprising:

a heating step of heating the recording head;

a detection step of detecting a temperature of the recording head;

a setting step of setting a target temperature of the recording head;

a control step of controlling a temperature of the recording head to be above the target temperature; and a timing step of measuring a time period during which the detected temperature of the recording head is above the target temperature, wherein said control step controls the temperature by heating control for heating the recording head above the target temperature and then effecting diffusing control to permit the heat to diffuse in the recording head, and wherein said control step effects the diffusing control during a period from the heating control to a start of a recording operation, and enables the diffusing control until the time period measured in said timing step during which the temperature of the recording head is above the target temperature becomes greater than a predetermined time period.

* * * * *